US005695149A

United States Patent [19]

Schulze et al.

[11] Patent Number: 5,695,149

[45] Date of Patent: Dec. 9, 1997

[54] CARRIER-ROLLER WINDER

[75] Inventors: Reiner Schulze; Günter Aster; Hans-Jürgen Bradersen, all of Hamburg, Germany

[73] Assignee: Beiersdorf Aktiengesellschaft, Hamburg, Germany

[21] Appl. No.: 348,412

[22] Filed: Dec. 2, 1994

[30] Foreign Application Priority Data

Dec. 11, 1993 [DE] Germany ..... 43 42 277.2

[51] Int. Cl.[6] ..... B65H 19/26

[52] U.S. Cl. ..... 242/533.4

[58] Field of Search ..... 242/533, 533.4, 242/533.5, 533.6

[56] References Cited

U.S. PATENT DOCUMENTS

| | | | |
|---|---|---|---|
| 1,750,487 | 3/1930 | Okuura | 242/533.6 |
| 2,334,793 | 11/1943 | Scusa | 242/533.5 |
| 2,585,226 | 2/1952 | Christman | 242/533.4 |
| 2,586,833 | 2/1952 | Kohler et al. | 242/533.4 |
| 2,970,786 | 2/1961 | Justus et al. . | |
| 3,019,411 | 5/1962 | Hearns | 242/533.4 |
| 3,552,670 | 1/1971 | Hearman | 242/533.4 |
| 4,208,019 | 6/1980 | Dusenbery | 242/533.4 |
| 4,529,141 | 7/1985 | McClenathan | 242/533.4 |
| 4,588,138 | 5/1986 | Spencer | 242/533.6 |
| 4,846,416 | 7/1989 | Natale | 242/533.5 |
| 4,963,223 | 10/1990 | Biagotti . | |
| 4,971,263 | 11/1990 | Belongia et al. | 242/533.4 |
| 5,035,373 | 7/1991 | Perrigo | 242/533.4 |
| 5,054,707 | 10/1991 | Olson | 242/533.5 |
| 5,221,056 | 6/1993 | Walliser et al. | 242/533.4 |

FOREIGN PATENT DOCUMENTS

| | | | |
|---|---|---|---|
| 1288400 | 1/1969 | Germany . | |
| 7919424 | 10/1979 | Germany . | |
| 59-57847 | 4/1984 | Japan | 242/533.4 |
| 2-86529 | 3/1990 | Japan | 242/547 |
| 2-95649 | 4/1990 | Japan | 242/547 |
| 2-217113 | 8/1990 | Japan | 242/533.4 |
| 2 161 793 | 1/1986 | United Kingdom | 242/533.4 |
| 2247670 | 3/1991 | United Kingdom . | |

*Primary Examiner*—John P. Darling
*Attorney, Agent, or Firm*—Sprung Horn Kramer & Woods

[57] ABSTRACT

Carrier-roller winder having at least two winding stations, in which in the first winding station, a web is wound onto a core, whilst a second winding station is connected upstream from the first such that, at least at the moment the strip is cut, this is led over a cutting and guide roller (1') of the second station, the cutting and guide roller (1') being configured as a suction roller, such that, once the cut is completed, on the one hand the web end is wound over a cutting and guide roller (1) of the first winding station, which is likewise designed as a suction roller, and on the other hand the web beginning is led from the cutting and guide roller (1') of the second station to its wind-up zone, whereupon the first winding station is removed from its position and the second winding station is brought, as it continues winding, into the position of the first winding station, and an empty winding station, which is prepared for winding and which can also once again be the first emptied winding station, is brought into the position of the originally second winding station, the winding stations (1, 1') herein being able to be swivelled such that a carrier roller (2) of that station which is right now winding is horizontally disposed.

8 Claims, 4 Drawing Sheets

Figure 1:
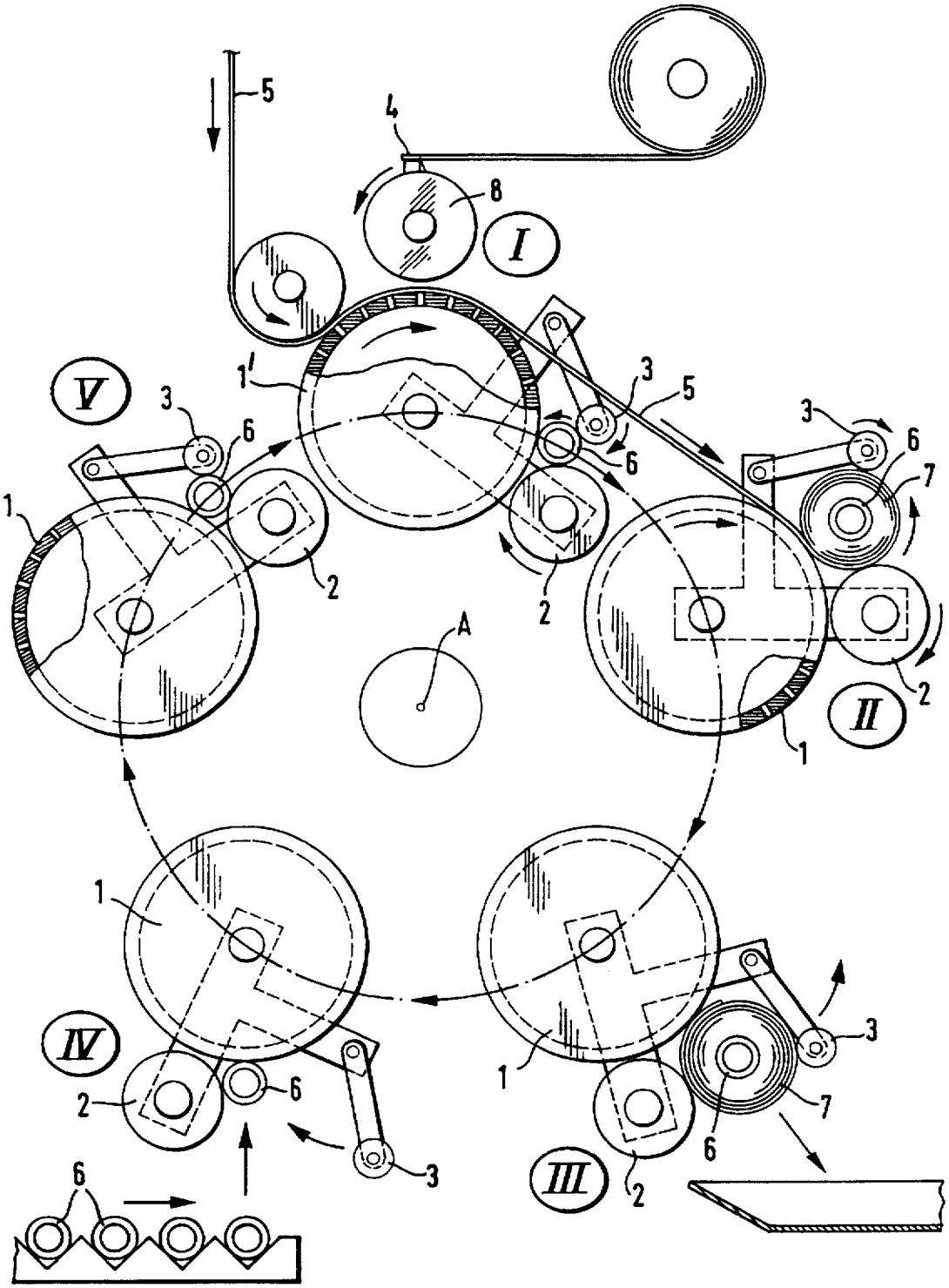

Fig. 2.1
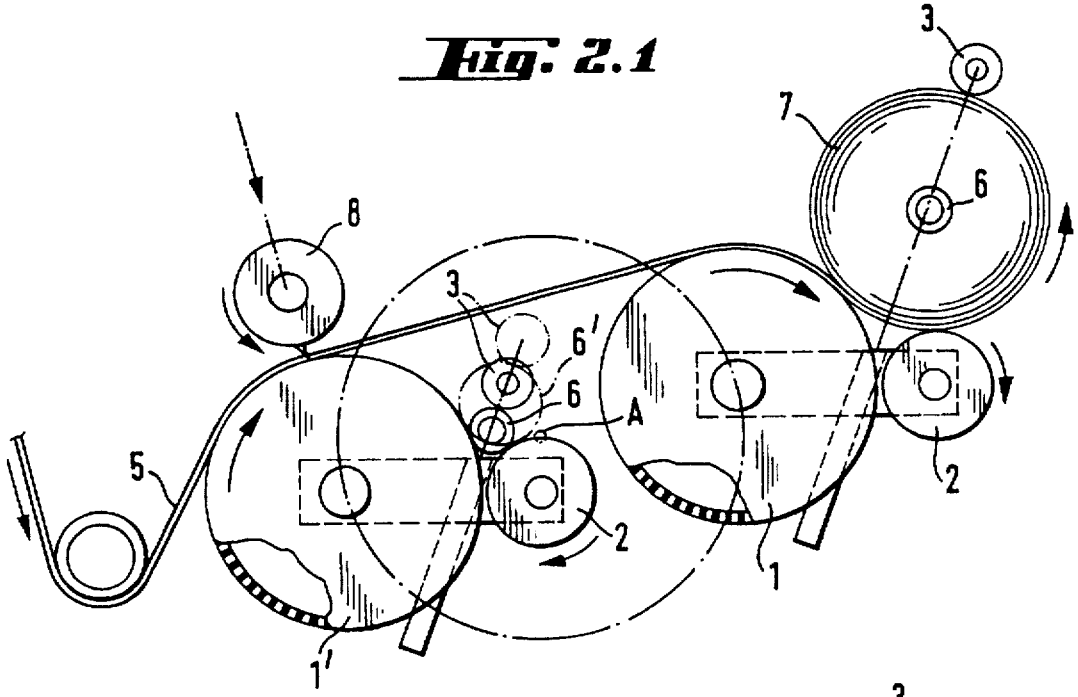
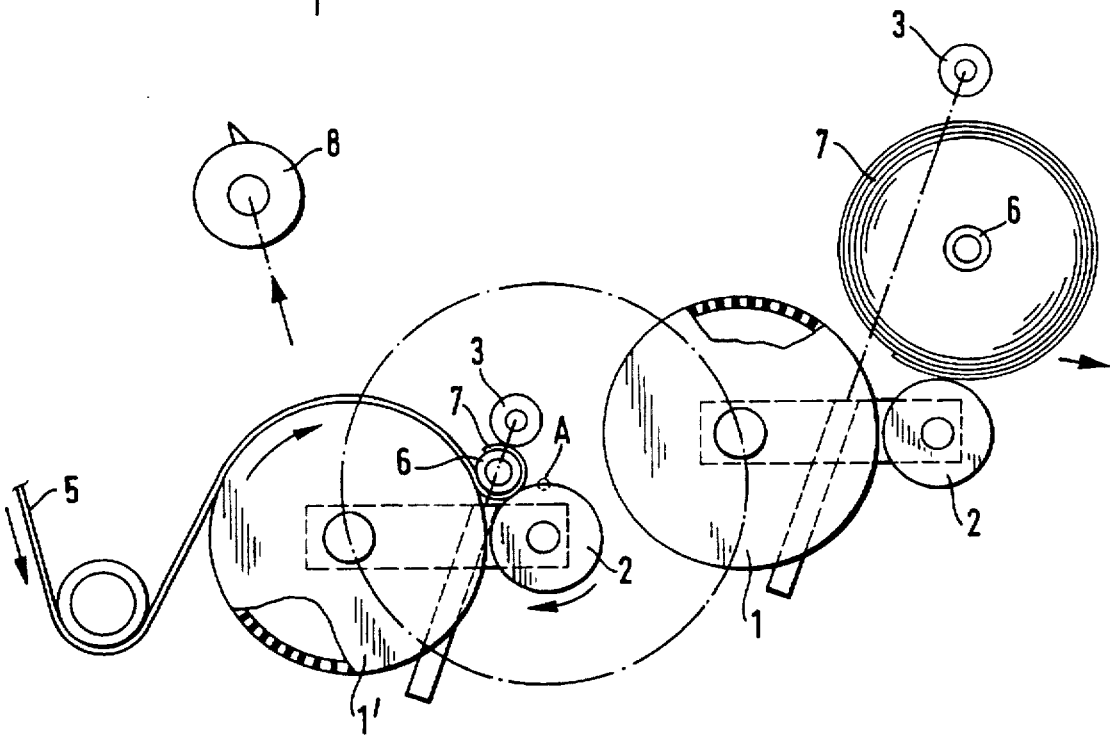
Fig. 2.2

Fig. 2.3
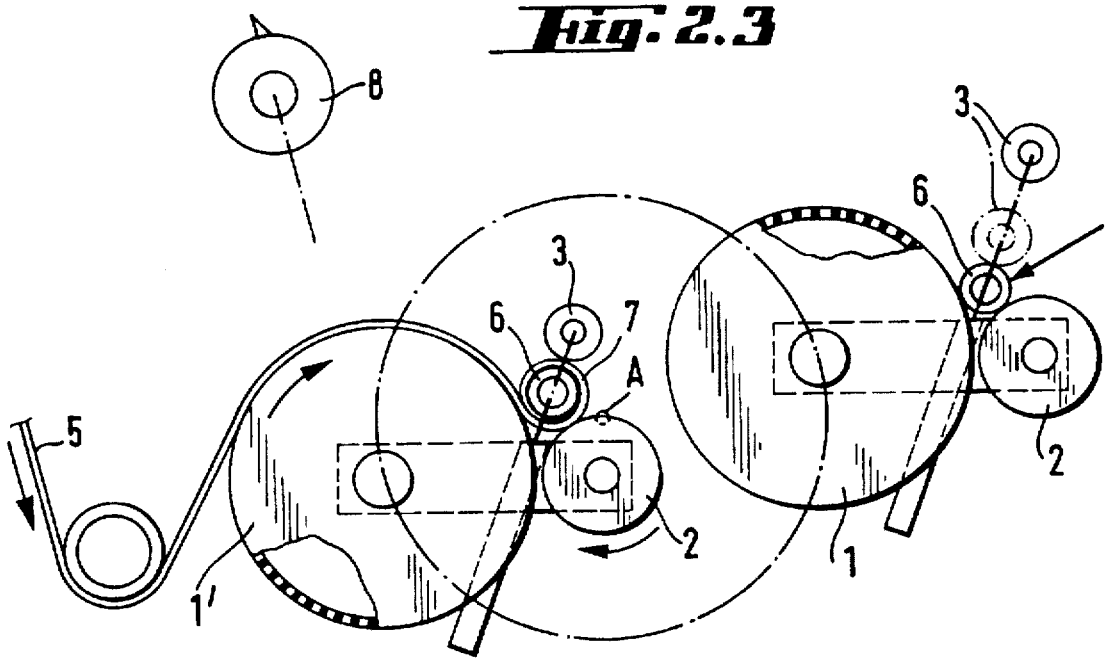
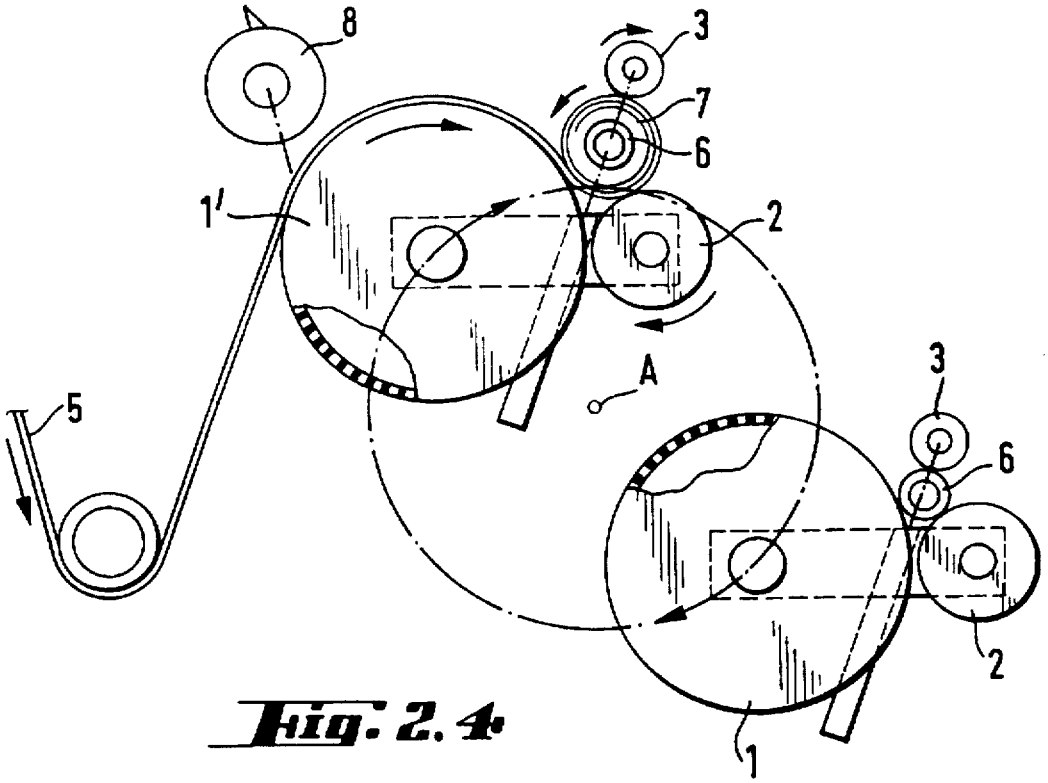
Fig. 2.4

Fig. 2.5
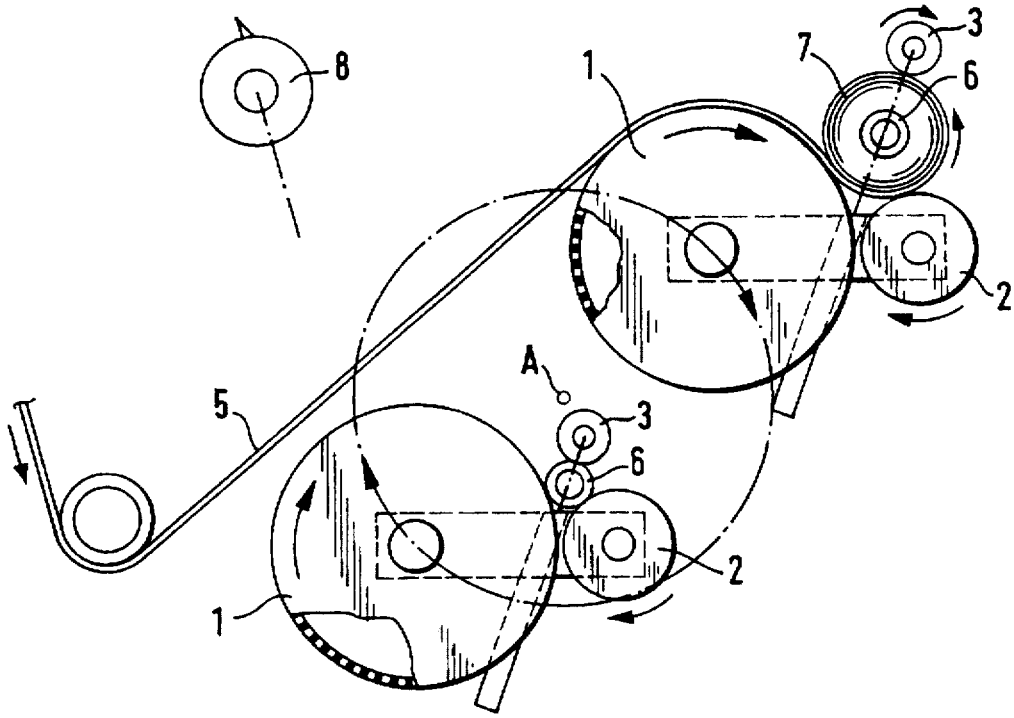
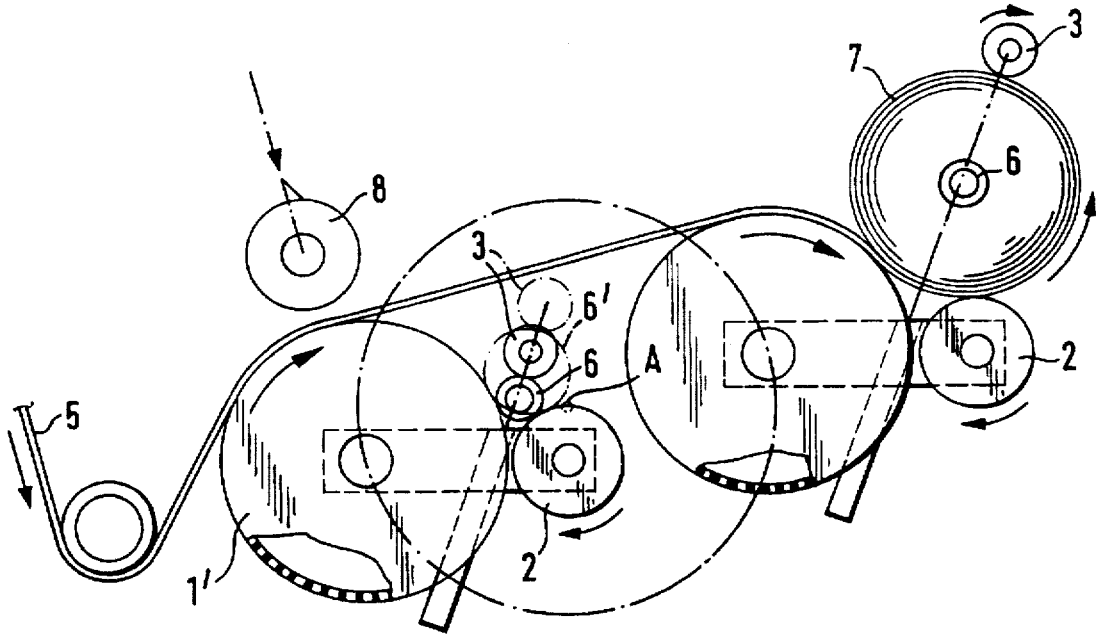
Fig. 2.6

CARRIER-ROLLER WINDER

The invention relates to a carrier-roller winder or, indeed, a bar winder for continuous high-performance winding of webs onto cores.

Carrier-roller winders are known in which, for the purposes of cutting-off and roll-changing, the web has to be stopped. The incoming material in this case has to be stored for a short time whilst the changeover is taking place.

This discontinuous procedure has drawbacks. For instance, the web speed is curtailed and the web material severely stressed by stopping and re-starting, along with the tensions and sources of errors to which this inevitably gives rise.

In order, in a first step, to lessen these problems, a machine is presented in U.S. Pat. No. 2,970,786 which enables webs to be wound continuously onto cores. This machine possesses three winding stations which are disposed symmetrically and rotatably about an axis. In the first station the material web is wound, in the second the finished reel is removed as the third station is supplied with a new tube. Once the winding of a reel is concluded, a cutter is used to make a chopping cut to slice through the material web. The end of the web is wound onto the full reel, whereas the formed beginning of the web is introduced into the next winding station in such a way that a continuous winding is made possible.

Yet even this machine has serious drawbacks. The slicing of the web by means of a chopping cut does not result in a clean web end, which is absolutely necessary to allow the web to continue being wound without problems and free from error. Problems are also brought about by fact that the web is not forcibly led over the guide rollers. It is additionally worth remarking that the structure, described in the patent specification, of the carrier-roller winder in the individual winding station does not allow a constant pressure to be produced upon the respective reels by means of the pressure roller which is present, which constant pressure is a prerequisite for enabling the web to be wound evenly onto the core. The possible regulation of the pressure roller to obtain the desired constant pressure upon the reel calls for considerable complexity in control-engineering terms.

The object of the invention was to remedy this situation, in particular to provide a high-performance winder which does not, or at least not to the same extent, exhibit the depicted drawbacks.

The invention consequently relates to a carrier-roller winder as is specifically characterized in greater detail in the claims.

In a surprisingly simple manner and without great technical complexity, this winder allows rapid winding, in particular at web speeds of over 100 m/min., and without any stoppage or reduction in pace of the material web as the roll is being changed. An even and continuous high-performance winding is thereby enabled, which displays its merits, above all, with respect to short roll lengths and high web speeds.

The high-performance winding is made possible, on the one hand, by the clean cut, which is established with a cutter roller and is the prerequisite for a clean web beginning, a problem-free initial winding of the new reel being conditional upon a clean web beginning, and, on the other hand, by the forced guidance of the respective web end and web beginning, following the cut, by virtue of the design of the cutting and guide roller as a suction roller. The horizontal arrangement of the cutting and guide roller and of the carrier roller allows a constant pressure to be exerted by a pressure roller, without a complex control system, upon the reel currently being wound. An even winding is thus guaranteed, this being a for the high-performance winding.

The carrier-roller winder according to the invention is quite especially suitable for the winding of materials which are self-adhesive on one side, in particular for winding rolls of adhesive tape onto cores, as is carried out on an industrial scale and to a considerable extent in the above-described, previously known manner.

It is herein particularly advantageous that a continuous winding with no risk of creasing in the roll material is thus possible, without any stoppage as the roll is changed. A store in the material web, with all its drawbacks and complexity, can also be relinquished. There is the possibility moreover, in the continuous winding procedure, of firstly establishing a clean cut at the roll end and, if required, at the same time applying a toucher, a batch identification or the like. The roll change is herein able to be made at very high speeds, even if the roll lengths are short. The reel can in this case be driven by means of the carrier roller system, even without a winding shaft. Even small batch sizes are thus able to be produced economically. And even different core sizes can be substituted without difficulty, without any need for the continuous high-speed running to be interrupted or slowed down.

The design of such carrier-roller winders according to the invention is to be explained in greater detail below with reference to the figures, without thereby wishing to restrict the invention unnecessarily. More particularly, FIG. 1 shows a system having five winding stations, FIGS. 2.1 to 2.6 show the exemplary motional sequence on a system having two winding stations, in six steps. More particularly:

FIG. 2.1 shows the left station cut and subsequent initial winding of the new roll; right station: web end is wound up, then station stops.

FIG. 2.2 left station winds, cutter swivels back: right station: evacuation.

FIG. 2.3 left station: winds; right station: loading.

FIG. 2.4 turning operation.

FIG. 2.5 turning operation, the lower station being speeded up to web speed.

FIG. 2.6 cutter swivels in and original setting is reached.

The system represented in FIG. 1, having 5 winding stations, exhibits respectively a cutting and guide roller 1 and 1', with respectively a carrier roller 2 and a pressure roller 3. An identification strip 4 is provided to be applied to the web 5 as it is cut, the web 5 being able to be supplied, on its side facing away from the cutting and guide roller 1 and 1', with a self-adhesive coating. In the station 1' there is an empty winding core 6, ready for the web 5 to be wound on as soon as this is cut, whilst the corresponding winding core 6 in the station shown alongside on the right is already wound into a thicker roll 7, denoted by station II. In the station III, which is located thereunder in the clockwise direction, the pressure roller 3 is swivelled out and the wound roll 7 is evacuated, whilst in the adjoining station IV a new, empty winding core 6 is loaded. In the following station V, the pressure roller 3 is brought up to the winding core 6 and in the station I the web 5 is led over the cutting and guide roller 1' such that, when the web 5 is cut against this roller 1', the web end continues to be wound in the station II, whereas the web beginning, in station I, is wound onto its empty winding core 6.

In order to secure the guidance of the web, the cutting and guide rollers 1 and 1' respectively are advantageously designed as suction rollers, which can be operated at low underpressure.

Finally, the entire system can be swivelled in the clockwise direction such that the station I enters into the position of the station II shown next to it on the right, II into III, III into IV, etc. In II winding carried out, in III evacuation, in IV loading with an empty winding core 6, which is held in V. There the cutting and guide roller 1, before being swivelled onward into position I, is advantageously brought to web speed, so that the speed of the web 5 remains unchanged and the web 5 can be wound and cut in a rapid and fully continuous manner, free from tension and without stress. If a non-adhesive web 5 is intended to be wound, then, in the cutting operation in particular, a strip of doublesided adhesive tape can be applied (behind the cutter) so as to facilitate winding onto the new, empty core 6 and 6' respectively.

In FIGS. 2.1 to 2.6, a system having two winding stations is described in the individual phases of the motional sequence. In FIG. 2.1, in the right-hand system, the web is being wound onto the roll 7. The web 5 herein runs initially over the left cutting and guide roller 1' and then over the right cutting and guide roller 1 to the roll 7, which is supported by the carrier roller 2 and held by the pressure roller 3. In the winding station shown on the left, a carrier roller 2 supports either a small core (e.g. one inch) 6 or a larger core 6' (e.g. three inches), both made from cardboard, in particular, but also, where appropriate, from plastic or the like. As a result of the chosen structure having two horizontal rollers, the increasing weight of the reel is transferred to the carrier roller 2 and the cutting and guide roller 1. Using the pressure roller 3, it is now possible to exert a constant pressure upon the reel. This enables the web 5 to be very evenly wound, in particular at high web speeds. Once enough of the web 5 is wound onto the roll 7, a cut is made by means of the cutter roller 8, which is brought up to the cutting and guide roller 1'. The end of the web 5 is then wound onto the roll 7, whilst the new beginning of the web 5 is wound onto the core 6 or 6' of the left winding station. This is here realized as in all other cases, in particular in webs 5 supplied on one side with a self-adhesive coating, especially by virtue of this fact, without problems, since this web 5 then adheres to the core 6 or 6' and winds itself onto it.

In FIGS. 2.2 to 2.6, the represented sequence proceeds without any additional need for further specific explanations, the winding stations being swivelled, in the clockwise direction, about the axis A. In addition, reference is once again made to that stated with respect to FIG. 1.

We claim:

1. Carrier-roller winder having at least two winding stations, in which in the first winding station a web is wound onto a core, whilst a waiting second winding station having a core is connected upstream from the first such that, at least at the moment the web is cut and forms an end and a beginning web, this is led over a cutting and guide roller (1') of the second station, the cutting and guide roller (1') being configured as a suction roller, such that, once the cut is completed, on the one hand the web end is wound over a cutting and guide roller (1) of the first winding station, which is likewise designed as a suction roller, and on the other hand the web beginning is led from the cutting and guide roller (1') of the second station to a wind-up zone, whereupon the first winding station is removed from its position and the second winding station is brought, as it continues winding, into the position of the first winding station, and an empty winding station, which is prepared for winding, is brought into the position of the originally second winding station, the winding stations (1, 1') herein being able to be swivelled such that a carrier roller (2) of that station which is right now winding is horizontally disposed, the carrier roller and the cutting and guide roller being horizontally disposed.

2. Carrier-roller winder according to claim 1, characterized in that the winder comprises two to six winding stations.

3. Carrier-roller winder according to claim 1, characterized in that the web being wound is held by at least one pressure roller (3).

4. Carrier-roller winder according to claim 1, characterized in that the cores are disposed rotatably about an axis.

5. Carrier-roller winder according to claim 1, characterized in that, as the cutting takes place, an identification strip (4) can be applied to the cutting and guide roller (1').

6. Carrier-roller winder according to claim 1, characterized in that cover of winding stations which at any given time are not being wound can be disabled, emptied, loaded and speeded back up to web speed.

7. A carrier-roller winder consisting essentially of:

i) a first winding station II, ii) at least a second winding station, iii) means for maintaining the first winding station in operative winding position while the second winding station is out of operative winding position, iv) each winding station comprising a suction cutting and guide roller (1), and a carrier roller (2), v) means for winding a continuous sheet material about a core (6) placed in a winding station, vi) means for varying the rotational speeds of the winding stations and for matching the sheet running speeds of the winding stations, vii) means (8) for cutting a strip being wound about the core in said first winding station, and viii) means for moving the first winding station out of the operative winding position and the second into the operative winding position, whereby when the amount of sheet material on a core in the first winding station reaches a predetermined size, an empty core in the second winding station is brought to the sheet running speed, the suction roller of the second winding station is brought into contact with the running sheet, the sheet is cut, thereby freeing the first winding station, the running sheet is held by the suction roller of the second winding station and is then wound about a core in the second winding station, the first winding station is moved out of operative position, and the running second winding station is moved into operative position, and beginning of the winding in the second winding station the carrier roller and cutting and guide roller in the second winding station are always horizontally disposed, even during movement of the second winding station.

8. A method of continuously winding at substantially constant speed rolls from a web carrying an adhesive on one face, which comprises winding the web with a winder according to claim 7 with the adhesive face facing away from the suction roller, whereby, when the upstream portion of a cut web is suction-held by the suction roller of the second winding station, the adhesive face of the web is contacted by a core in the second winding station and is wound about said core.

* * * * *

UNITED STATES PATENT AND TRADEMARK OFFICE

CERTIFICATE OF CORRECTION

PATENT NO. : 5,695,149

DATED : December 9, 1997

INVENTOR(S) : Schulze, et al.

It is certified that error appears in the above-indentified patent and that said Letters Patent is hereby corrected as shown below:

Title page U.S.Patent Documents "3,019,411" should be --3,091,411--.

Title Page U.S. PATENT DOCUMENTS: After " 3,091,411 " delete " 5/1962 " and substitute -- 5/1963 --

Signed and Sealed this

Fifth Day of October, 1999

*Attest:*

*Attesting Officer*

Q. TODD DICKINSON

*Acting Commissioner of Patents and Trademarks*